US007665257B2

(12) United States Patent
Posey

(10) Patent No.: US 7,665,257 B2
(45) Date of Patent: Feb. 23, 2010

(54) WIND RESISTANT STRUCTURE FOR BUILDINGS

(75) Inventor: Bobby R. Posey, Maryville, TN (US)

(73) Assignee: Posey Innovations, LLC, Knoxville, TN (US)

( * ) Notice: Subject to any disclaimer, the term of this patent is extended or adjusted under 35 U.S.C. 154(b) by 295 days.

(21) Appl. No.: 11/613,655

(22) Filed: Dec. 20, 2006

(65) Prior Publication Data

US 2008/0148655 A1 Jun. 26, 2008

(51) Int. Cl.

| | |
|---|---|
| ***E04C 5/08*** | (2006.01) |
| ***E02D 27/00*** | (2006.01) |
| ***E04H 14/00*** | (2006.01) |
| ***E04B 7/04*** | (2006.01) |

(52) U.S. Cl. ..... 52/223.13; 52/223.14; 52/295; 52/236.3; 52/92.2

(58) Field of Classification Search ..... 52/92.1, 52/92.2, 92.3, 93.1, 93.2, 127.2, 223.1, 223.11, 52/223.13, 223.14, 223.5, 223.6, 241, 272, 52/293.3, 295, 290, 697, 690, 677, 696, 656.9, 52/300, 698, 299; 411/14, 342, 392, 466, 411/544, 916, 908

See application file for complete search history.

(56) References Cited

U.S. PATENT DOCUMENTS

| | | | | | |
|---|---|---|---|---|---|
| 1,562,784 | A | * | 11/1925 | Olsen | 52/714 |
| 1,803,723 | A | * | 5/1931 | Murphy | 52/366 |
| 2,611,160 | A | * | 9/1952 | Hanesse | 403/237 |
| 2,883,852 | A | * | 4/1959 | Midby | 52/236.8 |
| 2,966,708 | A | * | 1/1961 | Freeman, Jr. | 52/696 |
| 3,170,269 | A | * | 2/1965 | Dunnington | 52/293.3 |
| 3,413,773 | A | * | 12/1968 | Fitzgerald | 52/713 |
| 3,636,673 | A | * | 1/1972 | Monroe | 52/293.3 |
| 3,845,601 | A | * | 11/1974 | Kostecky | 52/290 |
| 4,080,771 | A | * | 3/1978 | Weller | 14/75 |
| 4,530,194 | A | * | 7/1985 | Linton et al. | 52/712 |
| 4,669,235 | A | * | 6/1987 | Reinen | 52/98 |
| 4,875,314 | A | * | 10/1989 | Boilen | 52/167.1 |
| 5,353,560 | A | * | 10/1994 | Heydon | 52/281 |
| 5,375,384 | A | * | 12/1994 | Wolfson | 52/295 |
| 5,384,993 | A | | 1/1995 | Phillips | |
| 5,448,861 | A | | 9/1995 | Lawson | |
| 5,491,935 | A | | 2/1996 | Coxum | |
| 5,531,054 | A | * | 7/1996 | Ramirez | 52/741.1 |
| 5,570,549 | A | | 11/1996 | Lung et al. | |
| 5,603,186 | A | * | 2/1997 | Zaffino | 52/23 |
| 5,606,837 | A | * | 3/1997 | Holizlander | 52/693 |
| 5,699,639 | A | * | 12/1997 | Fernandez | 52/707 |

(Continued)

OTHER PUBLICATIONS

Hurri-Bolt Inc., Icces Legacy Report, Aug. 1, 2002, 1-9, 9910A, ICC Evaluation Service Inc.

*Primary Examiner*—Richard E Chilcot, Jr.
*Assistant Examiner*—James Ference
(74) *Attorney, Agent, or Firm*—Luedeka, Neely & Graham PC

(57) ABSTRACT

Certain embodiments of the invention disclosed herein include an apparatus and method for securing a wall system together in a vertical direction. More specifically, an apparatus is disclosed that includes a first floor lower linkage beam attached to a foundation of a structure. In another embodiment, a method is disclosed including attaching a first floor lower linkage beam to a foundation of a structure.

14 Claims, 19 Drawing Sheets

U.S. PATENT DOCUMENTS 5,761,863 A 6/1998 Sutt, Jr. et al.
6,105,332 A 8/2000 Boyadjian
6,161,339 A 12/2000 Cornett, Sr. et al.
6,195,949 B1 3/2001 Schuyler
6,209,268 B1 * 4/2001 Schmidt ..... 52/92.1
6,412,233 B1 7/2002 Jones
6,430,881 B1 * 8/2002 Daudet et al. ..... 52/92.2
6,625,945 B2 * 9/2003 Commins ..... 52/293.3
6,843,027 B2 1/2005 Gaddie et al.
6,854,237 B2 * 2/2005 Surowiecki ..... 52/633
6,871,456 B1 * 3/2005 Mueller ..... 52/167.4
6,871,470 B1 * 3/2005 Stover ..... 52/648.1
7,007,432 B2 * 3/2006 Commins ..... 52/293.3
7,021,021 B2 * 4/2006 Saldana ..... 52/696
7,080,487 B1 * 7/2006 Mueller ..... 52/167.3
7,127,862 B2 * 10/2006 Saldana ..... 52/715
7,140,155 B1 * 11/2006 Nasimov ..... 52/236.8
7,150,132 B2 * 12/2006 Commins ..... 52/293.3
7,216,465 B2 * 5/2007 Saldana ..... 52/655.1
7,287,355 B2 * 10/2007 Commins ..... 52/223.14
2002/0100226 A1 8/2002 Huppert
2003/0093969 A1 * 5/2003 Saldana ..... 52/715
2003/0182875 A1 10/2003 Hill
2004/0118053 A1 6/2004 Huppert
2005/0193681 A1 9/2005 Brackett
2005/0284057 A1 * 12/2005 Commins ..... 52/295

* cited by examiner

WIND RESISTANT STRUCTURE FOR BUILDINGS

FIELD

This invention relates to the field of building construction. More particularly, this invention relates to an apparatus and method system for securing at least a portion of a truss structure of a building to a foundation wall of the building.

BACKGROUND

The art and science of building construction is influenced by many factors including the need for comfort, shelter, insulation, aesthetic tastes, and durability. All of these factors, to some extent, are functions of the forces of nature including climate and weather patterns. One significant weather phenomenon that plays a determinative role in the effectiveness of a particular building structure is wind.

Strong winds may be found in a variety of climate zones including the harsh arctic regions where freezing winds blow, tropical regions where hurricanes (a.k.a., cyclones or monsoons), and any climatic zone that has the potential to spawn natures most concentrated storms, tornadoes. In short, strong winds have the potential to wreak havoc on building structures almost anywhere in the world.

A common problem with certain buildings in high wind zones occurs when air is forced under roof overhangs or other similar surfaces on a building, creating pressure along underside surfaces of such roof overhangs. If the pressure increases past a certain point, such pressure creates a lifting force to tear roofs and part or all of any associated joist system off of the building. Such events often trigger the complete collapse of such buildings. The relative ease at which such destructive events occur is often due to weak construction connections between the truss system of such buildings—particularly the roof trusses—and the foundations of such buildings.

What is needed, therefore, is an improved building structure capable of reinforcing the connection between a foundation of a building and the various joist members in the building.

SUMMARY

The above and other needs are met by an apparatus for securing a wall system together in a vertical direction. The apparatus includes a foundation and a plurality of anchors attached to the foundation. First floor joists are situated above the foundation and a first floor platform is supported thereon. A first floor linkage beam, including a first floor elongate linkage beam base and a first floor linkage beam parallel flange, is located on the first floor platform. A plurality of first floor elongate connectors connect the anchors to the first floor linkage beam. First floor studs are attached to the first floor linkage beam parallel flange, thereby securing the foundation to the first floor studs.

In a related embodiment, the apparatus described above includes a subfloor linkage beam, including an elongate subfloor linkage beam base and a subfloor linkage beam parallel flange, located on the foundation. The subfloor linkage beam parallel flange extends downwardly and is attached to the foundation.

The apparatus described above also may include a first floor top plate, a first floor upper linkage beam, a plurality of second floor joists, a second floor platform, a second floor lower linkage beam, and a plurality of second floor elongate connectors. The first floor top plate is located on the first floor studs. The first floor upper linkage beam, including an elongate first floor upper linkage beam base, a first floor upper linkage beam parallel flange, and a plurality of first floor upper linkage beam perpendicular flanges, is located on the first floor top plate. The first floor upper linkage beam parallel flange is preferably attached to the first floor studs. The plurality of second floor joists are located on the first floor upper linkage beam and are preferably received in and attached to the first floor upper linkage beam perpendicular flanges. The second floor platform is located on the second floor joists, and the second floor lower linkage beam is located on the second floor platform. The second floor elongate connectors connect the first floor upper linkage beam to the second floor lower linkage beam, thereby securing the wall structure together. The second floor lower linkage beam includes an elongate second floor lower linkage beam base and a second floor lower linkage beam parallel flange. The second floor lower linkage beam flange is preferably attached to a plurality of second floor studs.

In another embodiment, the apparatus described above includes a roof top plate on the first floor wall studs, a plurality of roof joists, and a roof linkage beam. The roof linkage beam includes an elongate roof linkage beam base, a roof linkage beam parallel flange, and a plurality of roof linkage beam perpendicular flanges for receiving the roof joists. The roof linkage beam parallel flange is attached to the first floor wall studs described above. In an alternative embodiment, the roof linkage beam parallel flange is attached to the second floor wall studs described above.

A method for securing a wall system together in a vertical direction is also disclosed including the steps of laying a foundation, inserting anchors in the foundation, placing first floor joists on the foundation, placing a first floor platform on the first floor joists, placing a first floor lower linkage beam onto the first floor platform, attaching the anchors to the first floor lower linkage beam, and attaching a plurality of first floor wall studs to the first floor lower linkage beam. The first floor linkage beam includes an elongate first floor linkage beam base and a first floor lower linkage beam parallel flange. A related embodiment includes the steps of placing a roof top plate on the first floor wall studs, placing a roof linkage beam on the roof top plate, and attaching roof joists to roof linkage beam perpendicular flanges on the roof linkage beam. Similar embodiments include additional steps for adding additional layers for structures with multiple levels.

Another embodiment disclosed herein includes an apparatus for securing portions of a wall system together. The apparatus includes an elongate base plate with a first surface and a second surface. The apparatus also includes an elongate parallel flange attached along the base plate in a substantially parallel orientation to the base plate, extending substantially normal to the first surface of the base plate. The apparatus also includes a plurality of perpendicular flanges attached to the second surface of the base plate in a substantially perpendicular orientation to the base plate, extending substantially normal to the second surface of the base plate. The perpendicular flanges are arranged to receive one or more joists.

BRIEF DESCRIPTION OF THE DRAWINGS

Further advantages of the invention are apparent by reference to the detailed description in conjunction with the figures, wherein elements are not to scale so as to more clearly show the details, wherein like reference numbers indicate like elements throughout the several views, and wherein:

FIG. 1 depicts a side cutaway view of an apparatus for securing a wall system together in a vertical direction, including a first floor upper linkage beam and a plurality of first floor upper linkage beam perpendicular flanges;

DETAILED DESCRIPTION

Figure 1:
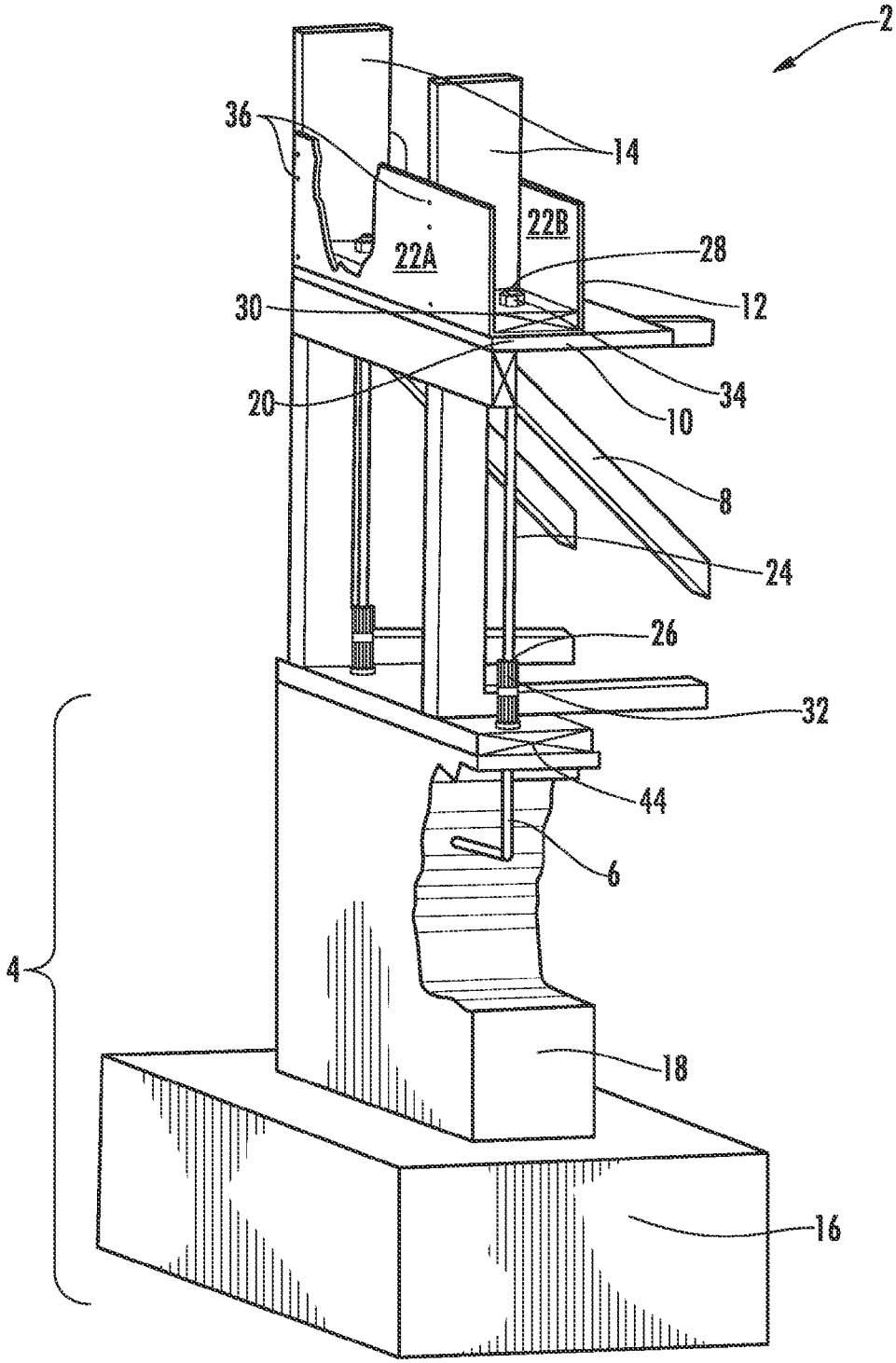
FIG. 1 depicts an isometric view of an apparatus for securing a wall system together in a vertical direction, including a first floor linkage beam.
Figure 2:
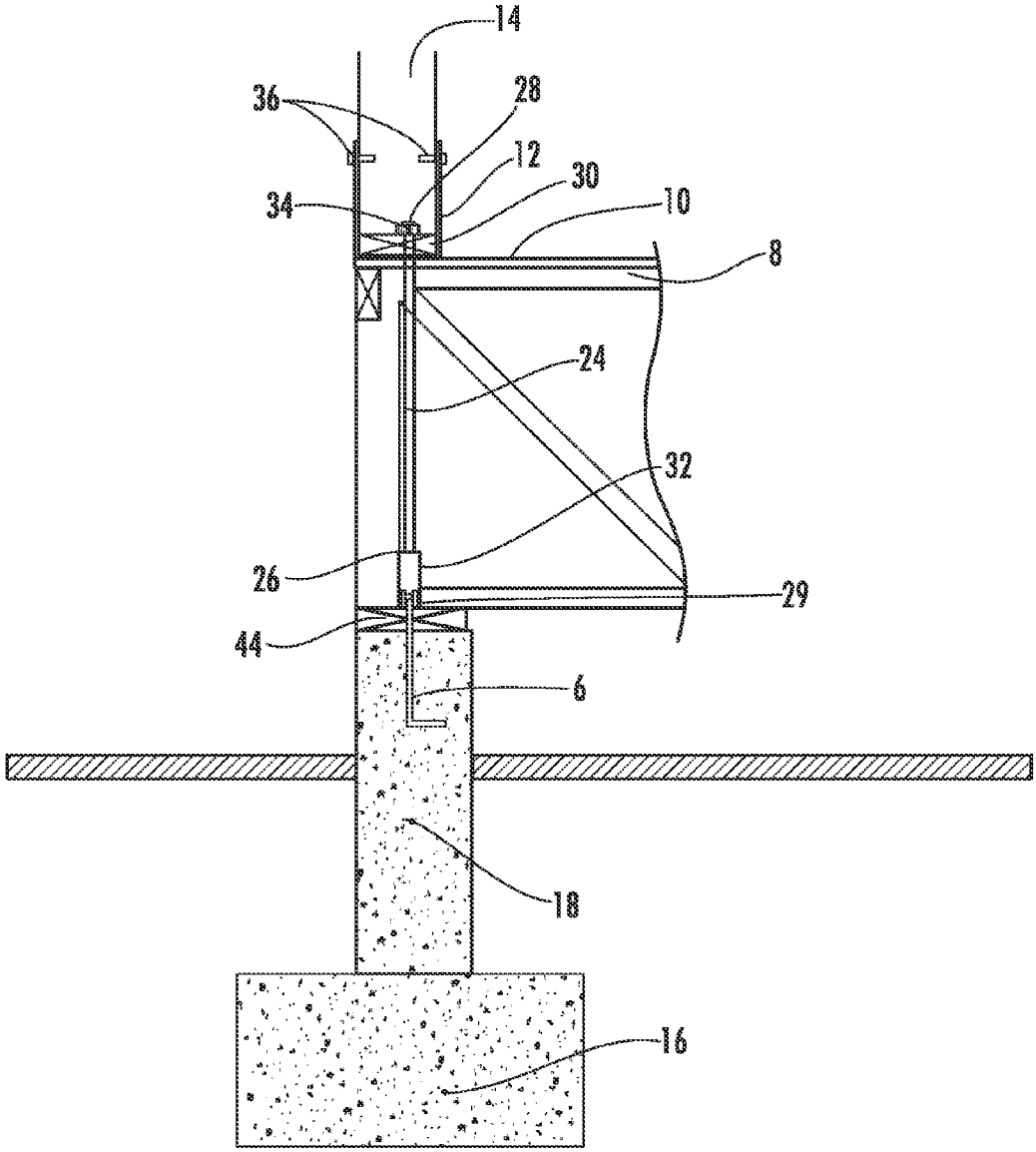
FIG. 2 depicts a side cutaway view of an apparatus for securing a wall system together in a vertical direction, including a first floor lower linkage beam.
Figure 3:
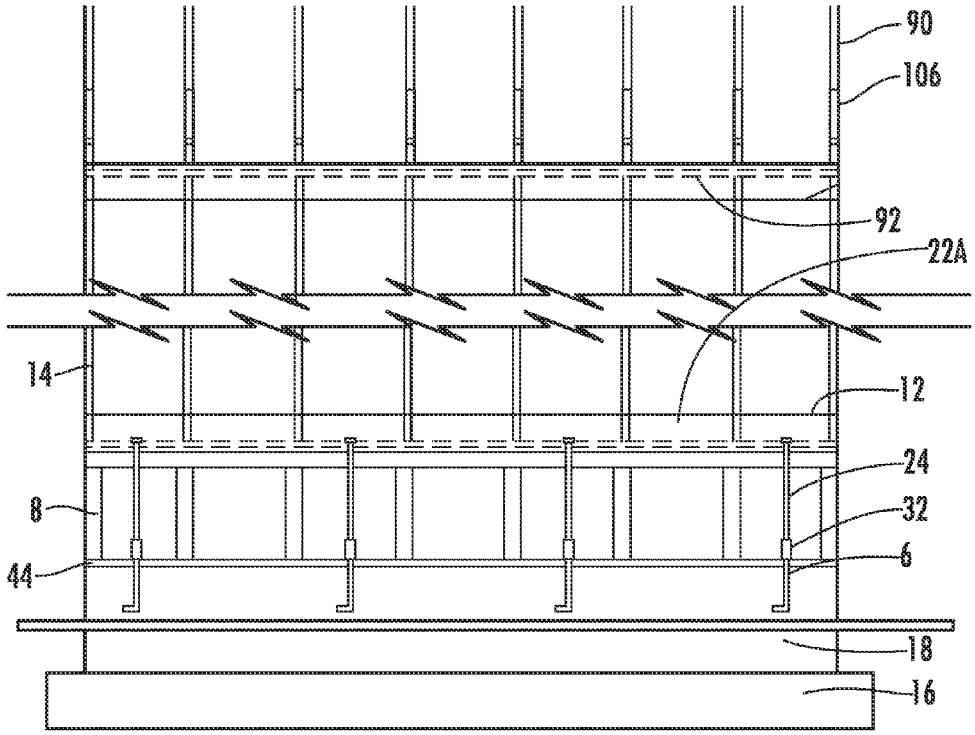
FIG. 3 depicts an elevation view of an apparatus for securing a wall system together in a vertical direction, including a first floor lower linkage beam.

FIGS. 1-3 depict a preferred embodiment of an apparatus for securing a wall system together in a vertical direction as described herein. A wall system 2 is shown in FIG. 1 including a foundation 4, an anchor 6, floor joists 8, first floor platform 10, first floor lower linkage beam 12, and a plurality of first floor wall studs 14. The foundation 4 includes a foundation base 16 and a foundation wall 18. The first floor linkage beam 12 includes an elongate first floor lower linkage beam base 20 and a first floor lower linkage beam parallel flange 22 extending upwardly from the first floor lower linkage beam base 20. First floor elongate connector 24, with first floor elongate connector first end 26 and first floor elongate connector second end 28, connects the anchor 6 to the first floor lower linkage beam 12. In the embodiment shown in FIGS. 1-3, a first floor sill 30 is located on the first floor lower linkage base 20; however, a first floor sill 30 is not required.

For the purposes of this disclosure, the term "joist" is meant to connote any type of beam, including trusses, set substantially parallel from wall to wall or across or abutting girders to support a floor or ceiling. Though only complex joist structures are shown in the figures (i.e., trusses), a viewer should understand these complex joists to represent any type of joist including simple beams of any reasonable proportion known to those skilled in the art. Additionally, the term "on" as used herein is meant to connote a physical relationship between at least two separate elements such that a first element "on" a second element is in direct contact with the first element or, alternatively, the second element is supported at a location substantially above the first element without direct contact between the first element and the second element. Also, the term "elongate connector" is meant to include any elongate member known to those skilled in the art capable of maintaining an appropriate tension when used with the apparatus described herein. Such elongate members may include high tensile strength rods, cables, or other similar connecting structures.

First floor elongate connector 24 is preferably threaded at first floor elongate connector first end 26 and first floor elongate connector second end 28. First floor elongate connector 24 may be threaded along its entire length as shown in FIG. 3, or not threaded at all. Anchor 6 includes an exposed end 29 that remains exposed from foundation 4 wherein exposed end 29 is preferably threaded. First floor elongate connector first end 26 is preferably attached to exposed end 29 of anchor 6 using a coupling device 32 such as a turnbuckle. However, any attachment means known to those skilled in the art for attached two rods end to end should suffice. The coupling device 32 is preferably capable tightening the relationship between the anchor 6 and the first floor elongate connector first end 26, thereby increasing the tension along the first floor elongate connector 24 between anchor 6 and first floor lower linkage beam 12. First floor elongate connector second end 28 is preferably attached to first floor lower linkage beam 12 by a first lower stud fastener 34 such as a nut. However, other attachment means known to those skilled in the art will suffice. For example, in one embodiment, the first floor elongate connector second end 28 may include an expanded head or a substantially flat head like a nail, thereby allowing for first floor elongate connector second end 28 to become tightened down above the first floor lower linkage beam base 20. First floor elongate connector 24 is preferably made from a high tensile strength material such as stainless steel of galvanized steel. However, it should be understood that any high tensile strength material known to those skilled in the art would suffice.

In a preferred embodiment, anchor 6 is shaped in the form of an "L" shape and is preferably made of a high tensile strength material such as stainless steel or galvanized steel. First floor lower linkage beam 12 is also preferably made of high tensile strength material such as stainless steel or galvanized steel. However, it should be understood that any high tensile strength material known to those skilled in the art would suffice for anchor 6 and first floor lower linkage beam 12. First floor lower linkage beam 12 preferably includes two first floor lower linkage beam parallel flanges (22A and 22B) as shown in FIGS. 1-3, wherein first floor lower linkage beam 12 resembles a "U" shape when viewed from one end. However, one first floor lower linkage beam parallel flange will suffice, forming an "L" shape in one embodiment when viewed from one end. However, more than two first floor lower linkage beam parallel flanges may be used.

As shown in FIGS. 1-3, first floor wall studs 14 are preferably attached to first floor lower linkage parallel flange 22 by first lower stud fasteners 36 such as stainless steel screws. However, any fastener known to those skilled in the art such as nails, bolts, or heavy duty tacks would suffice. Fasteners 36 are preferably inserted at an angle substantially parallel to the first floor lower linkage beam base 22. Such angle may range from about 70 degrees to about 110 degrees, more preferably from about 80 degrees to about 100 degrees, and still more preferably from about 85 degrees to about 95 degrees relative to the first floor lower linkage parallel flange 20.

Figure 4:
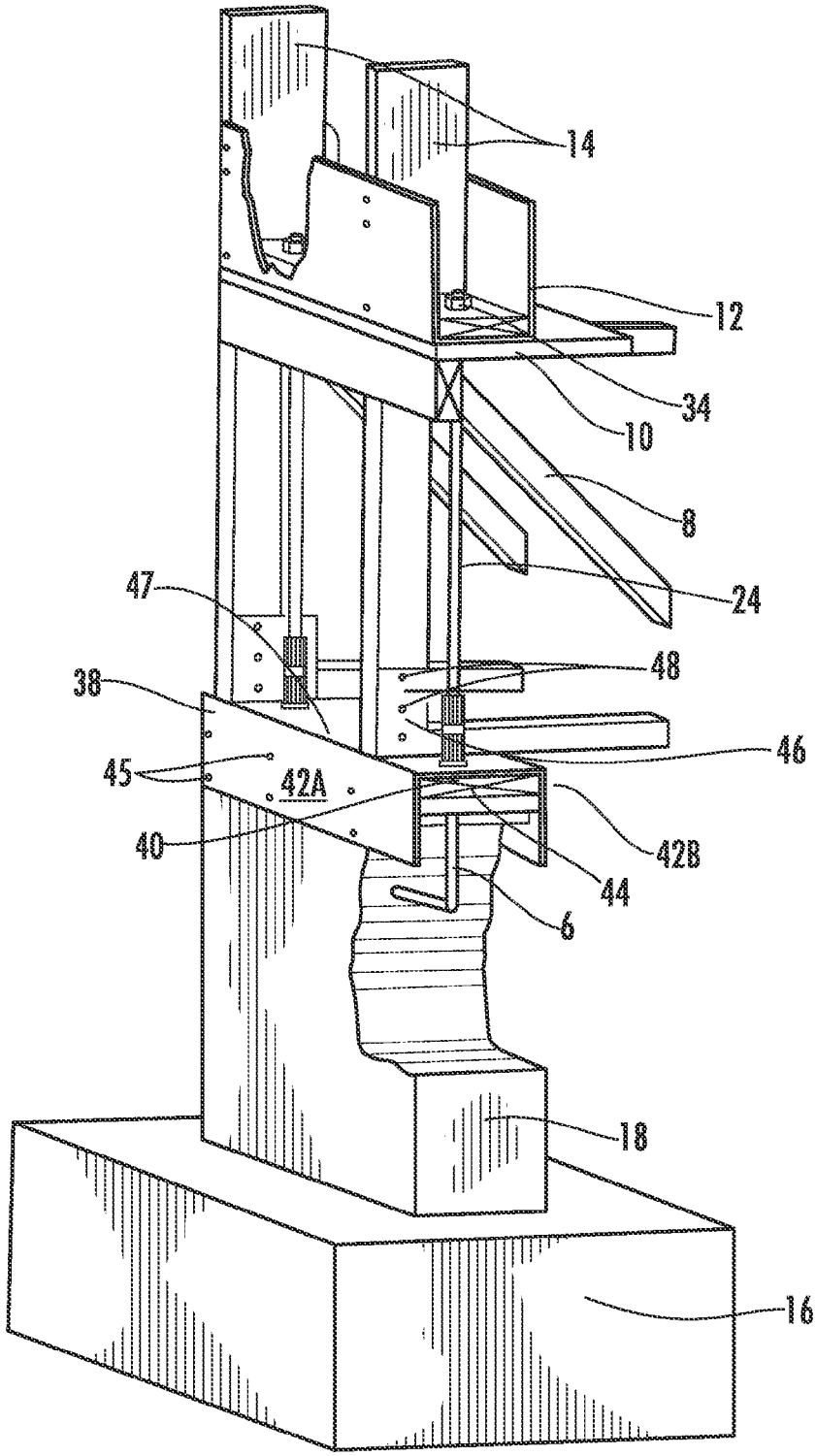
FIG. 4 depicts an isometric view of an apparatus for securing a wall system together in a vertical direction, including a first floor lower linkage beam and a subfloor linkage beam.
Figure 5:
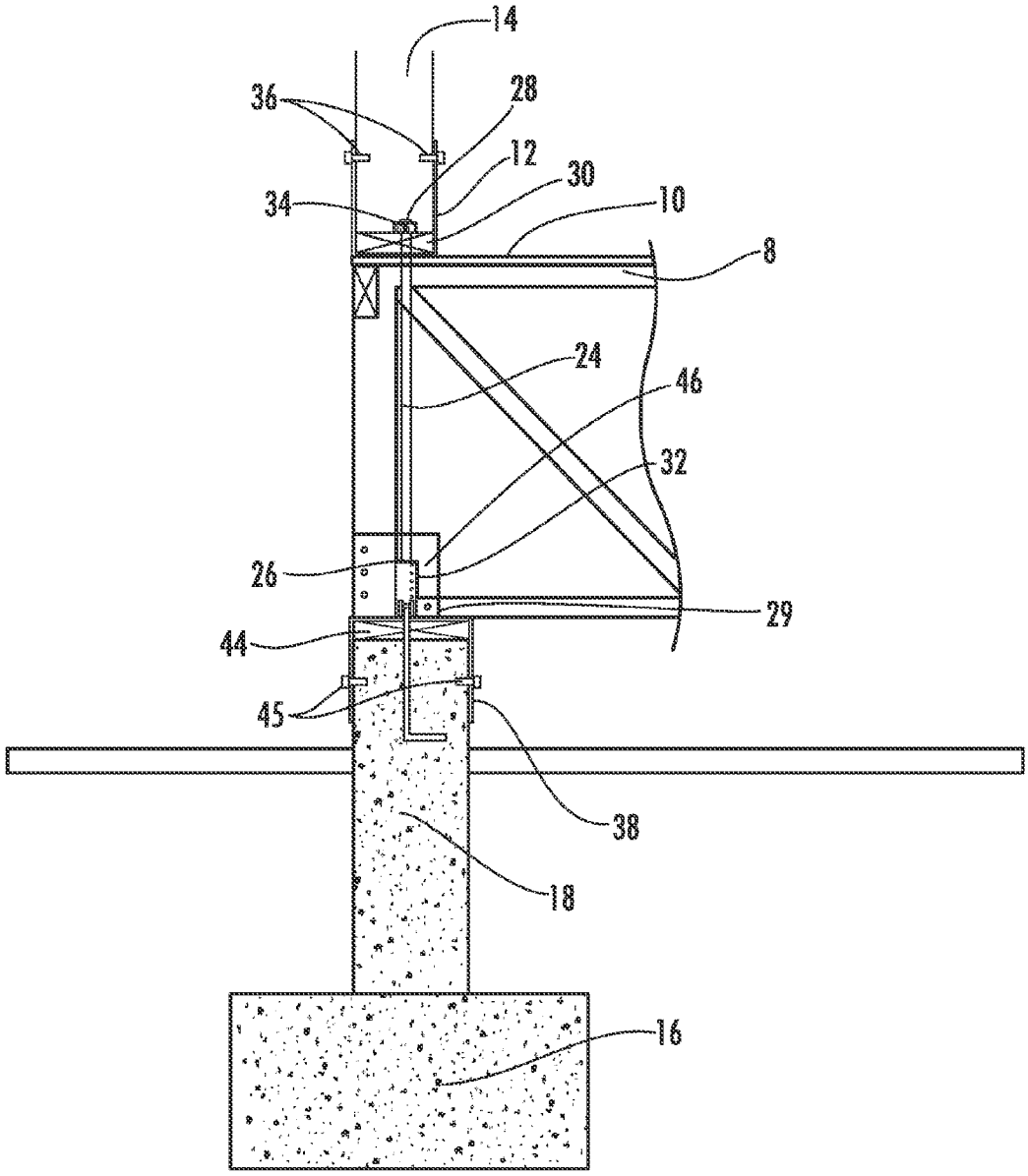
FIG. 5 depicts a side cutaway view of an apparatus for securing a wall system together in a vertical direction, including a first floor lower linkage beam and a subfloor linkage beam.
Figure 6:
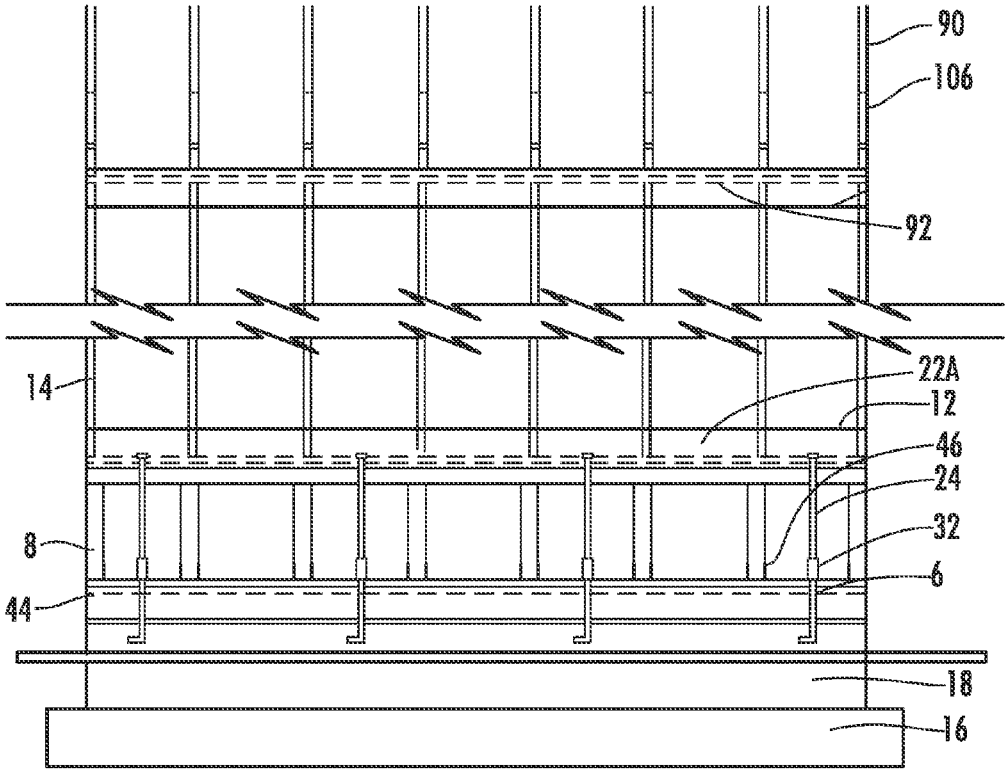
FIG. 6 depicts an elevation view of an apparatus for securing a wall system together in a vertical direction, including a first floor lower linkage beam and a subfloor linkage beam.

FIGS. 4-6 show an alternative embodiment of the apparatus discussed above including the addition of a subfloor linkage beam 38 supported by the foundation wall 18. As shown in FIG. 4, subfloor linkage beam 38 includes an elongate subfloor linkage beam base 40 and two subfloor linkage beam parallel flanges (42A and 42B) extending downward from the subfloor linkage beam base 40. The embodiment shown in FIGS. 4-6 includes a base sill 44 located between the foundation wall 18 and the subfloor linkage beam base 40. As with first floor lower linkage beam 12, subfloor linkage beam 38 preferably includes two subfloor linkage beam parallel flanges (42A and 42B) as shown in FIGS. 4-6, wherein subfloor linkage beam 38 resembles an upside down "U" shape when viewed from one end. However, one subfloor linkage beam parallel flange will suffice, forming an upside down "L" shape in one embodiment when viewed from one end. In other embodiments, more than two subfloor linkage beam parallel flanges may be used. Subfloor linkage beam 38 is preferably made of high tensile strength material such as stainless steel or galvanized steel. However, it should be understood that any high tensile strength material known to those skilled in the art would suffice.

Subfloor linkage beam parallel flanges 42 are preferably attached to foundation 4 by foundation fasteners 45 such as stainless steel screws. However, any fastener known to those skilled in the art such as nails, bolts, or heavy duty tacks would suffice. Foundation fasteners 45 are preferably inserted at an angle substantially parallel to the subfloor linkage beam base. Such angle may range from about 60 degrees to about 120 degrees, more preferably from about 80 degrees to about 100 degrees, and still more preferably from about 85 degrees to about 95 degrees relative to the subfloor linkage parallel flange (42A or 42B).

In addition to subfloor linkage beam parallel flanges (42A and 42B), subfloor linkage beam 38 also includes a plurality of subfloor linkage beam perpendicular flanges 46 extending upward from the top surface 47 of subfloor linkage beam, arranged to receive first floor joists 8 as shown in FIG. 4 and FIG. 6. First floor wall studs 14 are preferably attached to subfloor linkage beam perpendicular flanges 46 by first joist fasteners 48, wherein first joist fasteners 48 are preferably inserted at an angle substantially parallel to the subfloor linkage beam base. Such angle may range from about 60 degrees to about 120 degrees, more preferably from about 80 degrees to about 100 degrees, and still more preferably from about 85 degrees to about 95 degrees relative to the subfloor linkage perpendicular flange 46.

Figure 7:
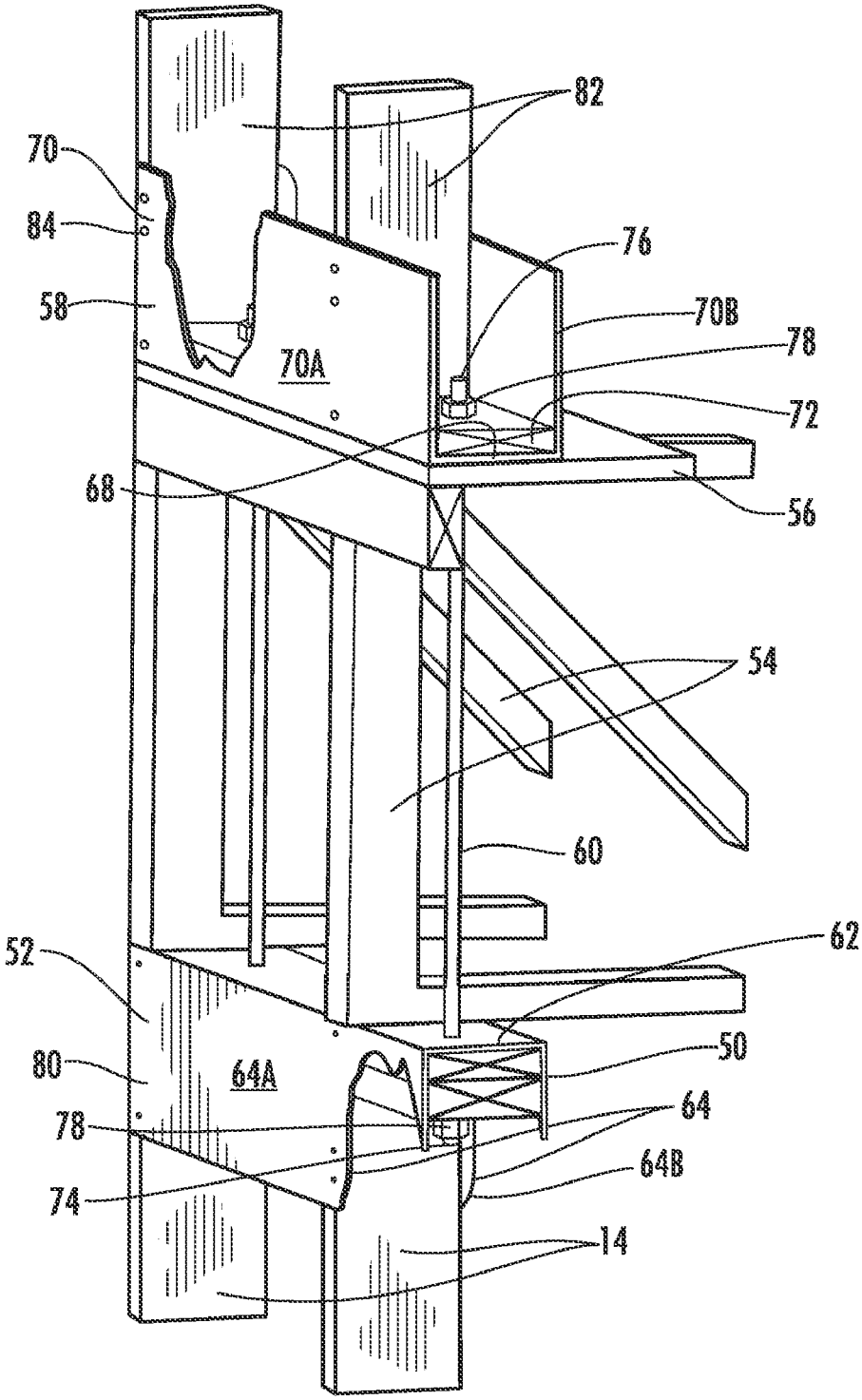
FIG. 7 depicts an isometric view of an apparatus for securing a wall system together in a vertical direction, including a first floor upper linkage beam.
Figure 8:
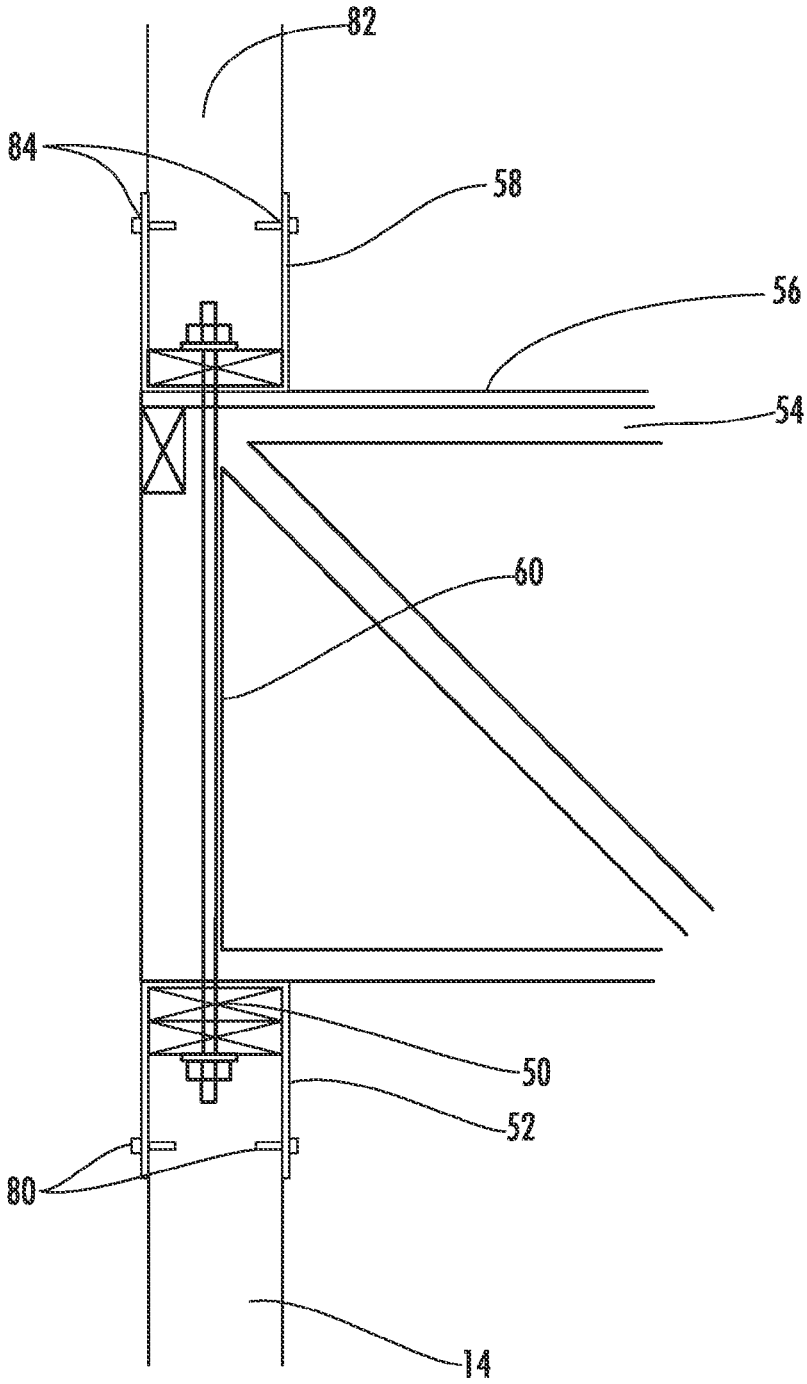
FIG. 8 depicts a side cutaway view of an apparatus for securing a wall system together in a vertical direction, including a first floor upper linkage beam.

Another related embodiment shown in FIGS. 7-8 includes a first floor top plate 50 supported on the first floor wall studs 14, a first floor upper linkage beam 52, second floor joists 54, a second floor platform 56, a second floor lower linkage beam 58, and a second floor elongate connector 60. The first floor top plate 50 shown in FIGS. 7-8 is a double top plate; however, a single top plate will suffice. The first floor upper linkage beam 52 includes an elongate first floor upper linkage beam base 62, at least one first floor upper linkage beam parallel flange 64, and, preferably, a plurality of first floor upper linkage beam perpendicular flanges 66 (shown in FIGS. 10-12). The second floor lower linkage beam 58 includes an elongate second floor lower linkage beam base 68 and an at least one second floor lower linkage beam parallel flange 70. The embodiment shown in FIGS. 7-9 includes a second floor sill 72; however, use of a second floor sill 72 is not required.

Figure 9:
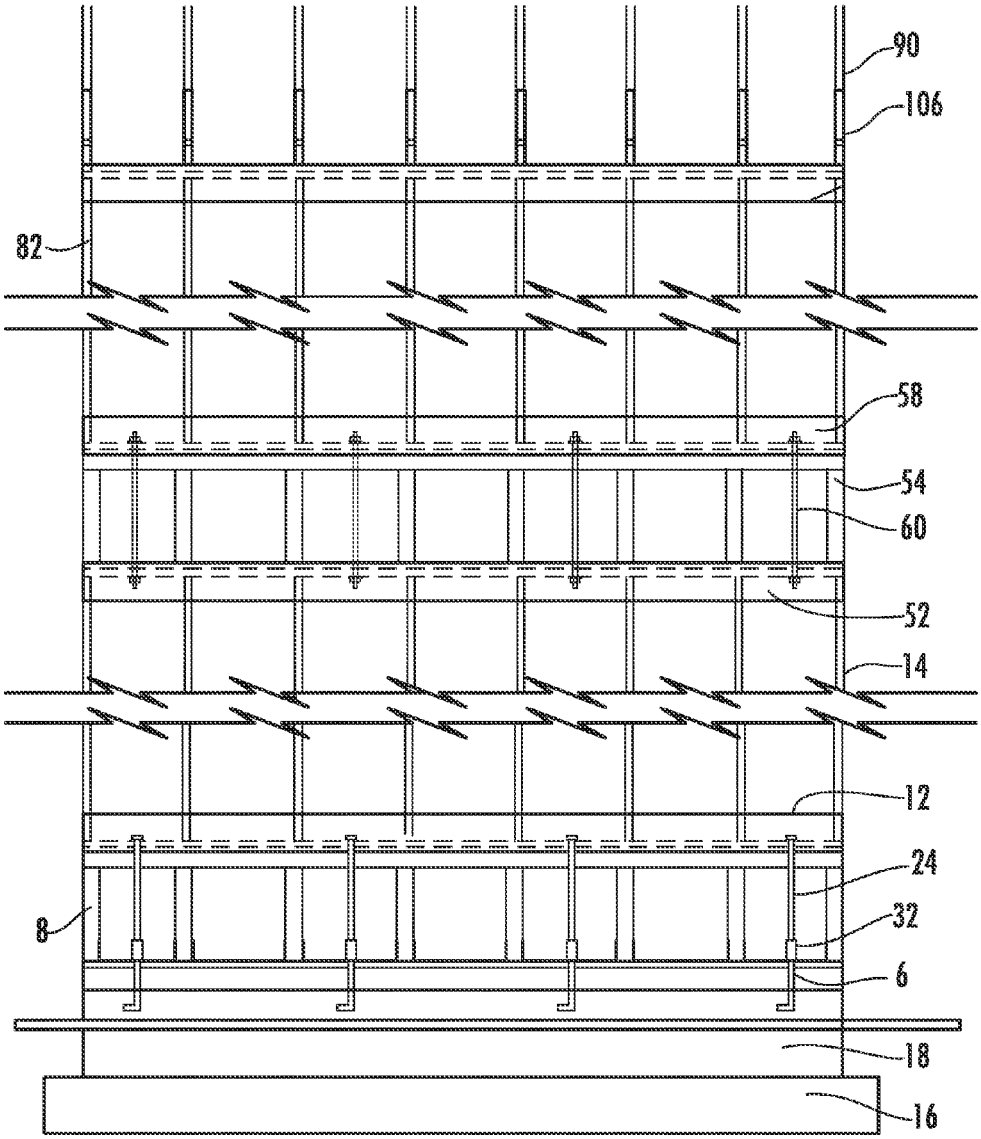
FIG. 9 depicts an elevation view of an apparatus for securing a wall system together in a vertical direction, including a first floor upper linkage beam.

Second floor elongate connector 60 is preferably threaded at second floor elongate connector first end 74 and second floor elongate connector second end 76. Second floor elongate connector 60 may be threaded along its entire length as shown in FIG. 9, or not threaded at all. Second floor elongate connector first end 74 is attached to first floor upper linkage beam 52 and second floor elongate connector second end is attached to second floor lower linkage beam 58, both preferably made by second floor rod fastening devices 78 such as nuts. However, other attachment means known to those skilled in the art will suffice. For example, in one embodiment, the second floor elongate connector first end 74 (or second floor elongate connector second end 76) may include an expanded head or a substantially flat head like a nail, thereby allowing for second floor elongate connector first end 74 to become tightened to the first floor upper linkage beam base 62 (or, alternatively, to allow for second floor elongate connector second end 76 to become tightened to the second floor lower linkage beam base 68). Second floor elongate connector 60 is preferably made from a high tensile strength material such as stainless steel of galvanized steel. However, it should be understood that any high tensile strength material known to those skilled in the art would suffice.

First floor upper linkage beam 52 preferably includes two first floor upper linkage beam parallel flanges (64A and 64B) as shown in FIGS. 7-8, wherein first floor upper linkage beam 52 resembles an upside down "U" shape when viewed from one end. Similarly, second floor lower linkage beam 58 preferably includes two second floor lower linkage beam parallel flanges (70A and 70B) as shown in FIGS. 7-8, wherein second floor lower linkage beam 58 also resembles a "U" shape when viewed from one end. However, one first floor upper linkage beam parallel flange will suffice, forming an upside down "L" shape in one embodiment when viewed from one end of first floor upper linkage beam 52. Similarly, one second floor lower linkage beam parallel flange will suffice, forming an "L" shape in one embodiment when viewed from one end of second floor lower linkage beam 58. In other embodiments, more than two first floor upper linkage beam parallel flanges 64 and/or second floor lower linkage beam parallel flanges 68 may be used. First floor upper linkage beam 52 is preferably made of high tensile strength material such as stainless steel or galvanized steel. However, it should be understood that any high tensile strength material known to those skilled in the art would suffice.

As shown in FIGS. 7-9, first floor wall studs 14 are preferably attached to first floor upper linkage beam parallel flanges 64 by first upper stud fasteners 80 such as stainless steel screws. Similarly, second floor wall studs 82 are preferably attached to second floor lower linkage parallel flanges 70 by second lower stud fasteners 84 such as stainless steel screws. However, any fastener known to those skilled in the art such as nails, bolts, or heavy duty tacks would suffice for either first upper stud fasteners 80 or second lower stud fasteners 84. First upper stud fasteners 80 are preferably inserted at an angle substantially parallel to the first floor upper linkage beam base 62. Such angle may range from about 70 degrees to about 110 degrees, more preferably from about 80 degrees to about 100 degrees, and still more preferably from about 85 degrees to about 95 degrees relative to the first floor upper linkage beam parallel flange 64. Similarly, second lower stud fasteners 84 are preferably inserted at an angle substantially parallel to the second floor lower linkage beam base 68. Such angle may range from about 70 degrees to about 110 degrees, more preferably from about 80 degrees to about 100 degrees, and still more preferably from about 85 degrees to about 95 degrees relative to the second floor lower linkage beam parallel flange 70.

Figure 10:
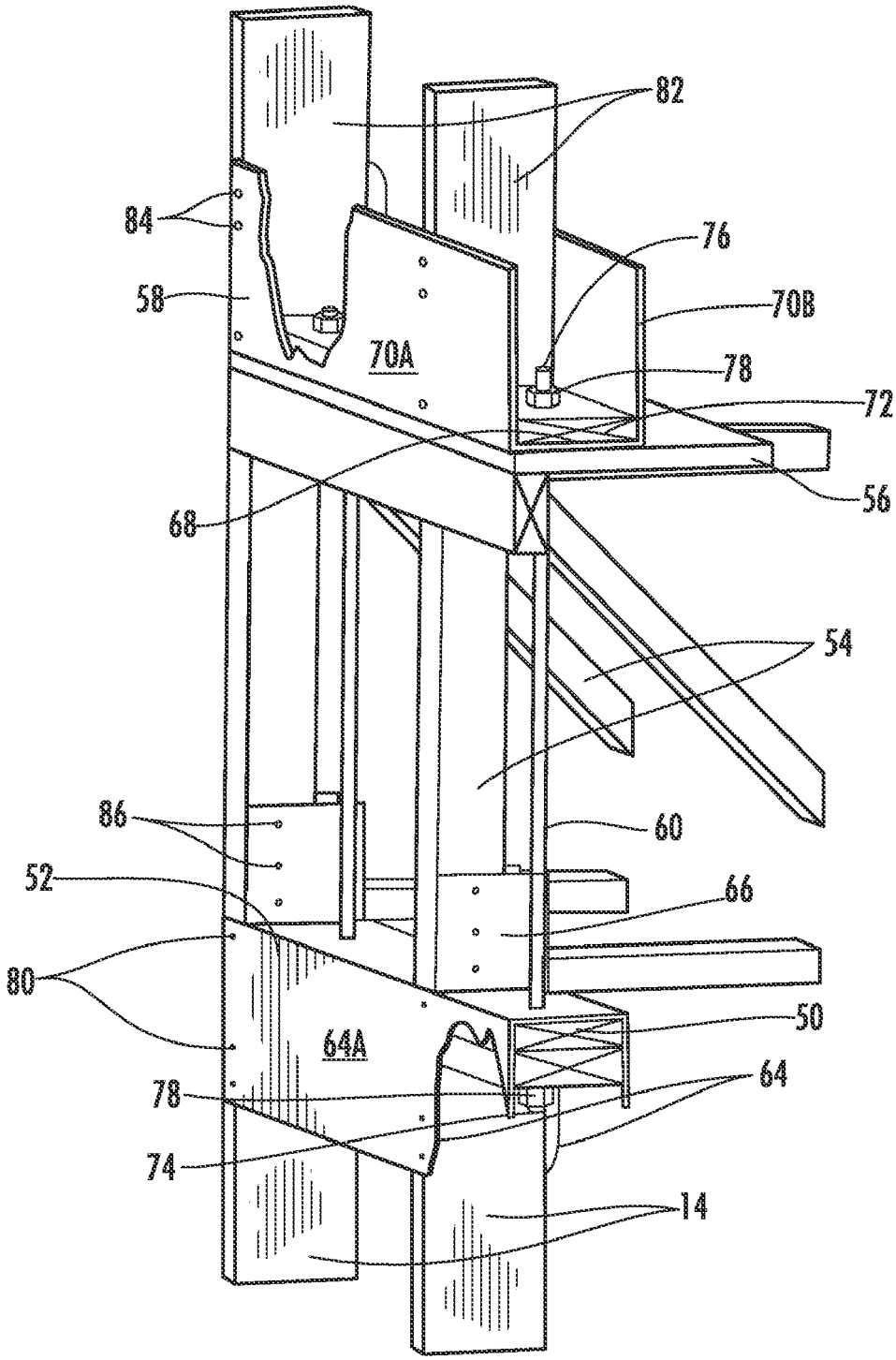
FIG. 10 depicts an isometric view of an apparatus for securing a wall system together in a vertical direction, including a first floor upper linkage beam and a plurality of first floor upper linkage beam perpendicular flanges.
Figure 11:
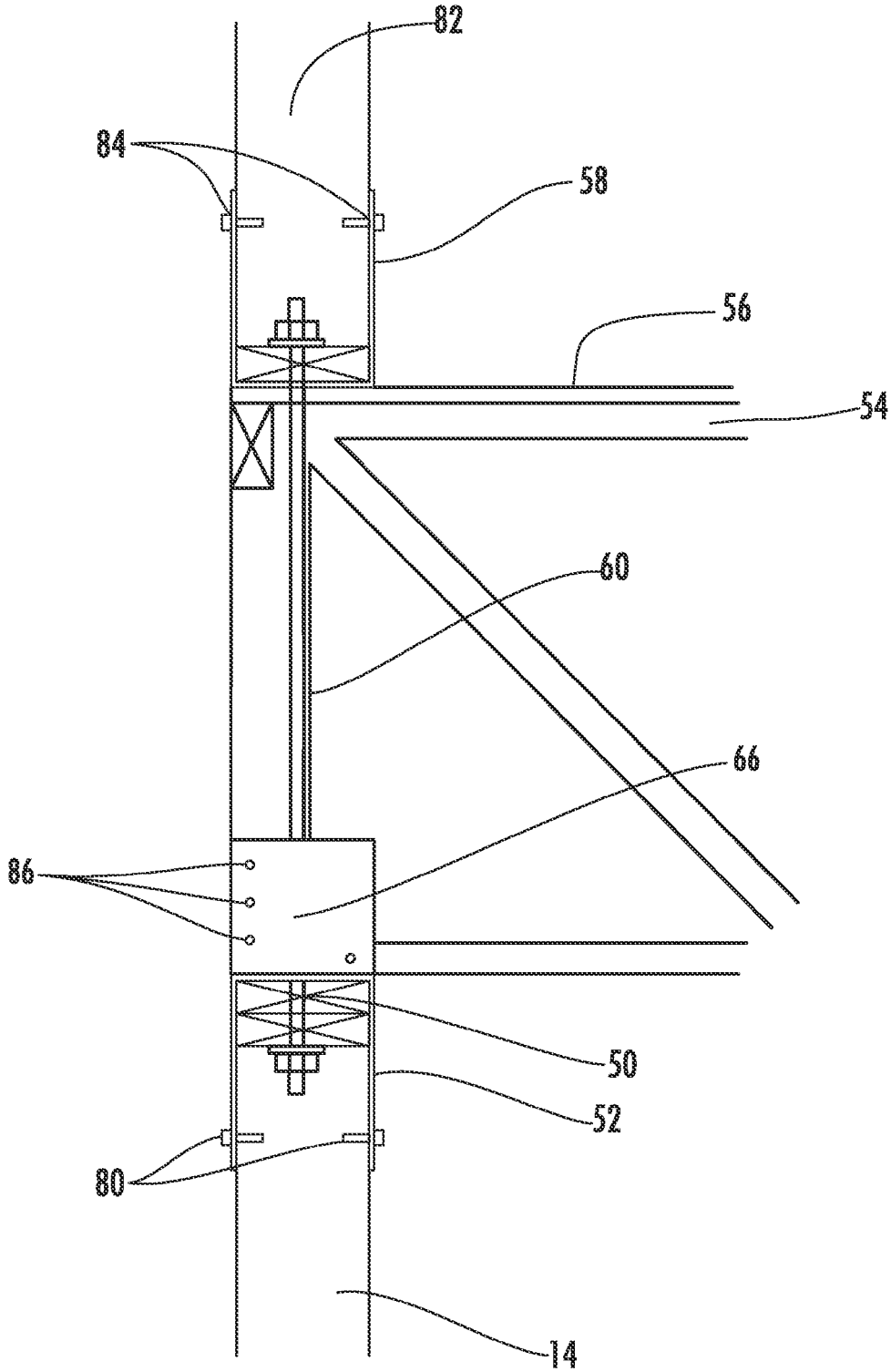

In a preferred embodiment shown in FIGS. 10-11, first floor upper linkage beam 52 includes first floor upper linkage beam perpendicular flanges 66, arranged to receive second floor joists 54. First floor upper linkage beam perpendicular flanges 66 are preferably attached to second floor joists 54 by second joist fasteners 86 such as stainless steel screws. However, any fastener known to those skilled in the art such as nails, bolts, or heavy duty tacks would suffice. Second joist fasteners 86 are preferably inserted at an angle substantially parallel to the first floor upper linkage beam base 62. Such angle may range from about 70 degrees to about 110 degrees, more preferably from about 80 degrees to about 100 degrees, and still more preferably from about 85 degrees to about 95 degrees relative to the first floor upper linkage beam perpendicular flanges 66.

Figure 13:
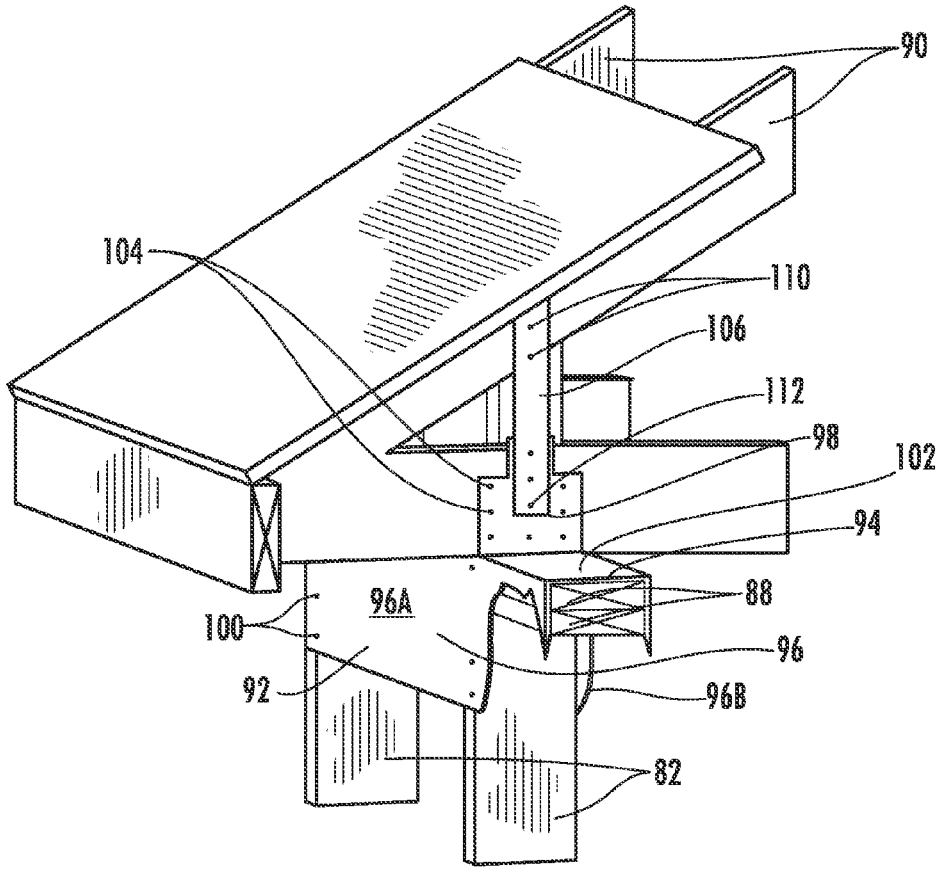
FIG. 13 depicts an isometric view of an apparatus for securing a wall system together in a vertical direction, including a roof linkage beam.
Figure 15A:
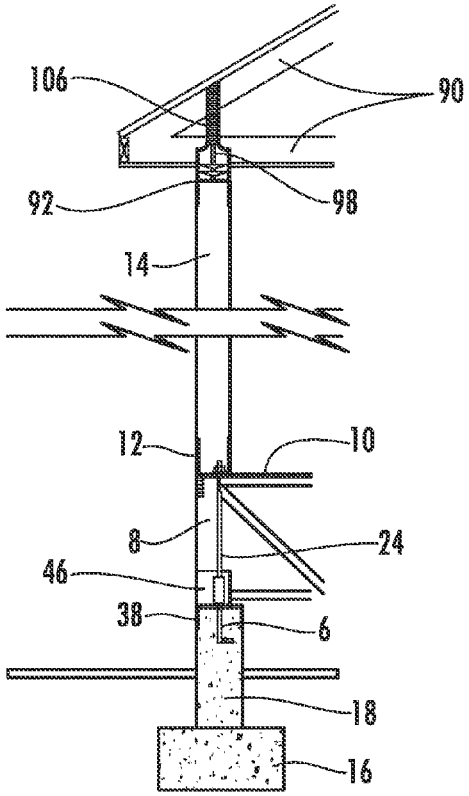
FIG. 15A depicts an elevation view of a one level embodiment of an apparatus for securing a wall system together in a vertical direction, including a first floor lower linkage beam and a roof linkage beam.
Figure 15B:
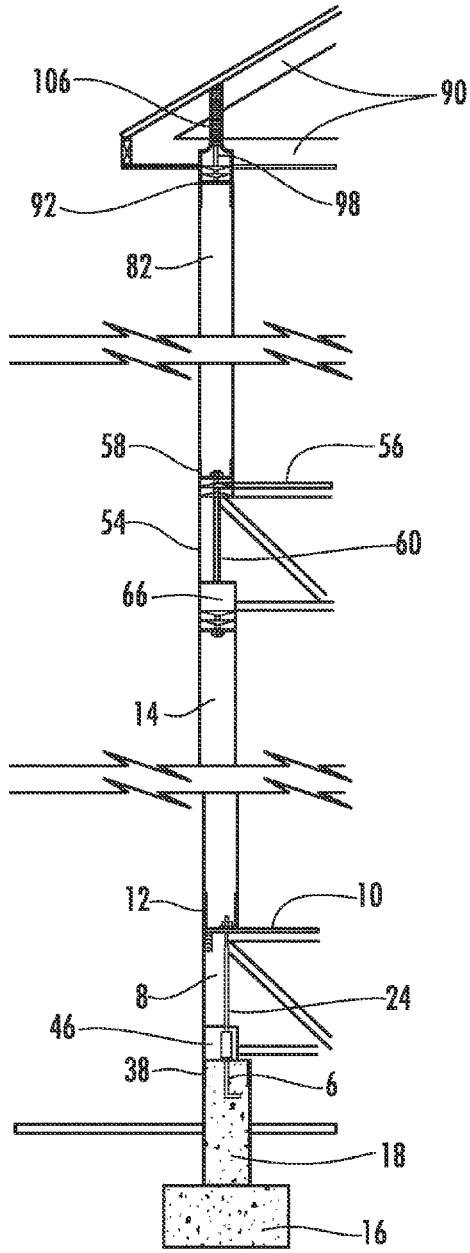
FIG. 15B depicts an elevation view of a two level embodiment of an apparatus for securing a wall system together in a vertical direction, including a first floor lower linkage beam, a second floor lower linkage beam, and a roof linkage beam.

FIG. 13 shows another embodiment with additional elements such as a roof top plate 88, roof joists 90, and roof linkage beam 92. Roof linkage beam 92 includes an elongate roof linkage beam base 94, at least one roof linkage beam parallel flange 96, and, preferably, a plurality of roof linkage beam perpendicular flanges 98. Roof top plate 88 may be supported substantially on first floor wall studs 14 as shown in FIG. 15A. Alternatively, roof top plate 88 may be supported substantially on second floor wall studs 82 as shown in FIG. 15B. Roof linkage beam 92 is supported substantially on roof top plate 88.

Roof linkage beam 92 preferably includes two roof linkage beam parallel flanges (96A and 96B) as shown in FIG. 13, wherein roof linkage beam 92 resembles an upside down "U" shape when viewed from one end. However, one roof linkage beam parallel flange will suffice, forming an upside down "L" shape in one embodiment when viewed from one end. In other embodiments, more than two roof linkage beam parallel flanges may be used. Roof linkage beam 92 is preferably made of high tensile strength material such as stainless steel or galvanized steel. However, it should be understood that any high tensile strength material known to those skilled in the art would suffice.

Figure 14:
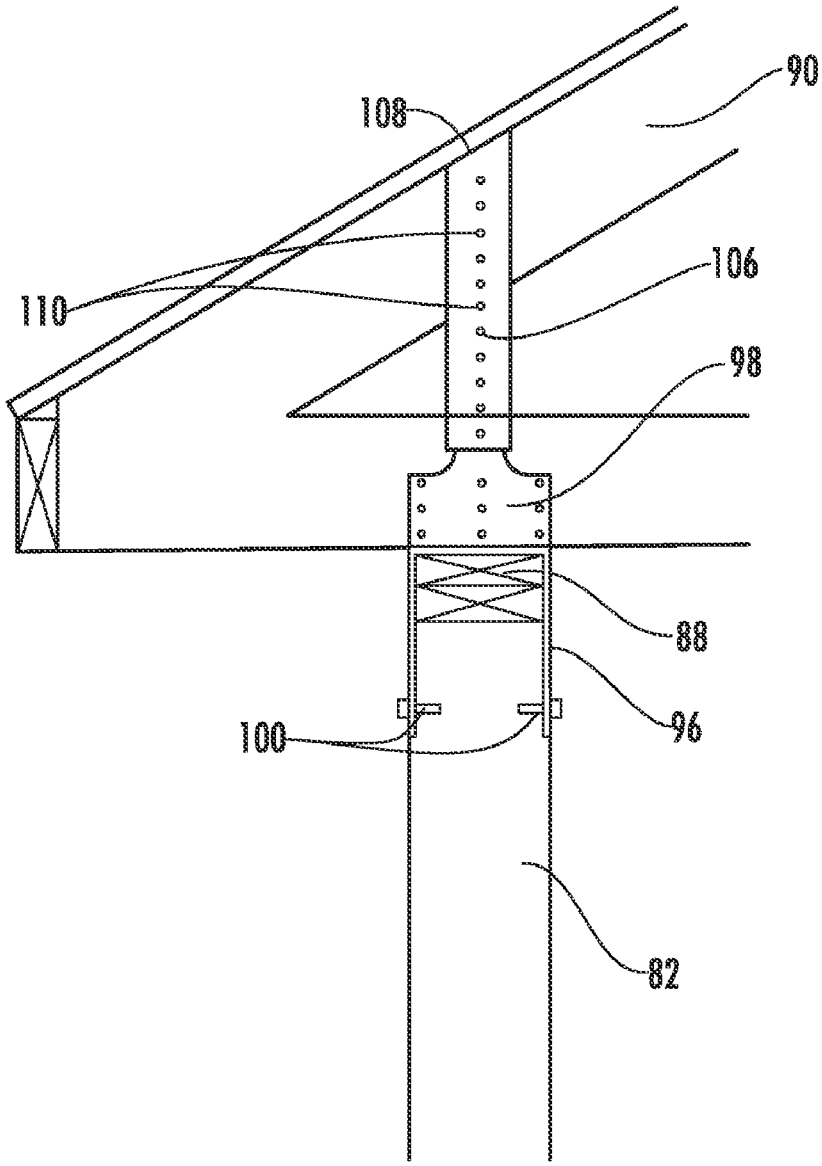
FIG. 14 depicts a side cutaway view of an apparatus for securing a wall system together in a vertical direction, including a roof linkage beam.

FIGS. 13, 14, and 15B show an embodiment wherein the roof top plate 88 includes a double plate. In this embodiment, second floor wall studs 82 are preferably attached to roof linkage parallel flanges 96 by second upper stud fasteners 100 such as stainless steel screws. However, any fastener known to those skilled in the art such as nails, bolts, or heavy duty tacks would suffice. Second upper stud fasteners 100 are preferably inserted at an angle substantially parallel to the roof linkage beam base. Such angle may range from about 70 degrees to about 110 degrees, more preferably from about 80 degrees to about 100 degrees, and still more preferably from about 85 degrees to about 95 degrees relative to the roof linkage beam parallel flanges 96. In an alternative embodiment as shown in FIGS. 13, 14, and 15A, first floor wall studs 14 are preferably attached to roof linkage parallel flanges 96 by second upper stud fasteners 100.

Figure 12:
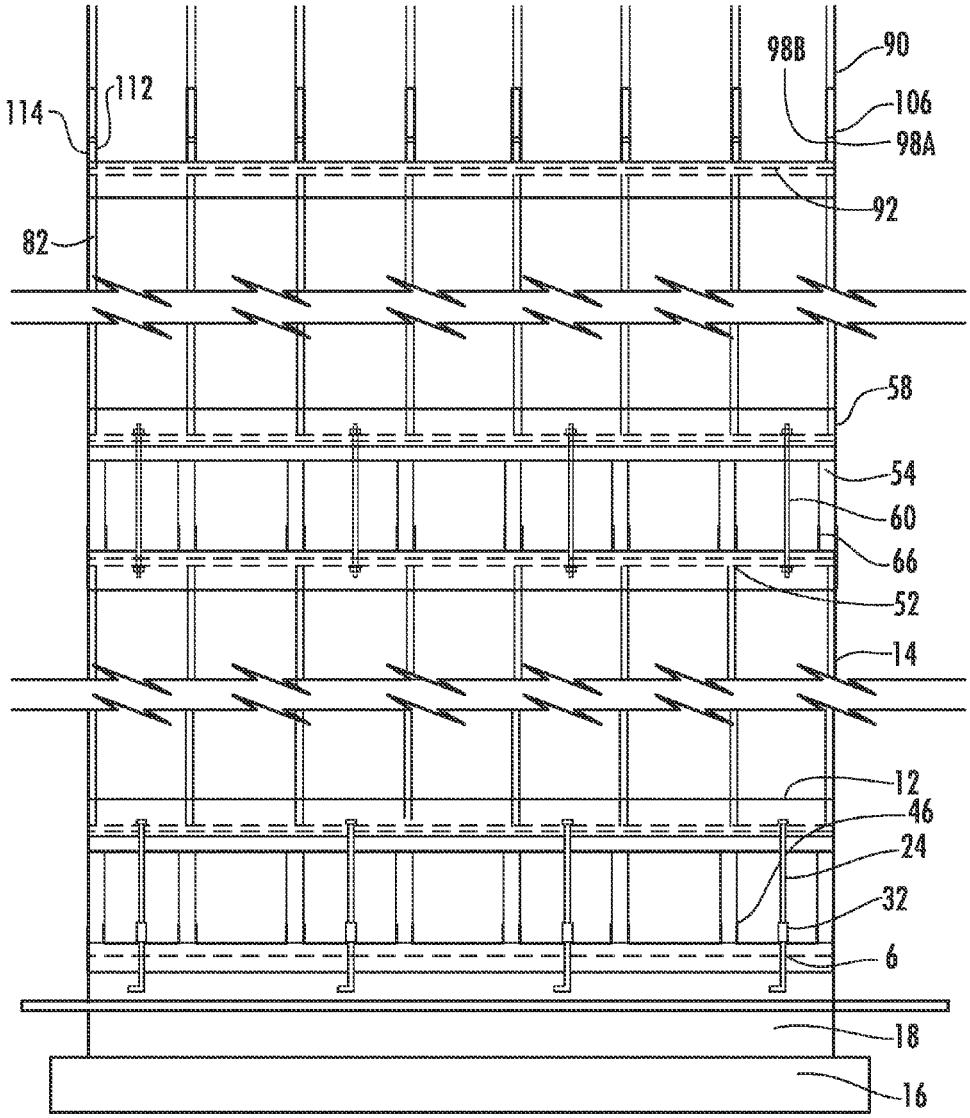
FIG. 12 depicts an elevation view of an apparatus for securing a wall system together in a vertical direction, including a first floor upper linkage beam and a plurality of first floor upper linkage beam perpendicular flanges.

Roof linkage beam 92 also preferably includes a plurality of roof linkage beam perpendicular flanges 98 extending upward from the top surface 102 of the roof linkage beam base 94, arranged to receive roof joists 90 as shown in FIG. 12. Roof joists 90 are preferably attached to roof linkage beam perpendicular flanges 98 by roof joist fasteners 104, wherein first joist fasteners are preferably inserted at an angle substantially parallel to the roof linkage beam base 94. Such angle may range from about 60 degrees to about 120 degrees, more preferably from about 80 degrees to about 100 degrees, and still more preferably from about 85 degrees to about 95 degrees relative to the roof linkage beam perpendicular flanges 98.

A roof joist strap 106 may also be attached to a roof linkage beam perpendicular flange 98. In a preferred embodiment, roof joist strap is attached to a first roof linkage beam perpendicular flange 98A, wrapped over an upper edge 108 of a roof joist 90, and then attached to a second roof linkage beam perpendicular flange 98B. Roof joist strap 106 is also preferably attached to roof joist 90 near the upper edge 108 of the roof joist 90, whether wrapped over upper edge 108 of the roof joist 90 or not. The roof joist strap is preferably attached to the roof joist 90 and/or roof linkage beam perpendicular flanges 98 by roof strap fasteners 110 such as stainless steel screws. However, any fastener known to those skilled in the art such as nails, bolts, or heavy duty tacks would suffice. Roof strap fasteners 110 are preferably inserted at an angle substantially parallel to the roof linkage beam base 94. Such angle may range from about 70 degrees to about 110 degrees, more preferably from about 80 degrees to about 100 degrees, and still more preferably from about 85 degrees to about 95 degrees relative to the roof joist strap 106.

Figure 16A:
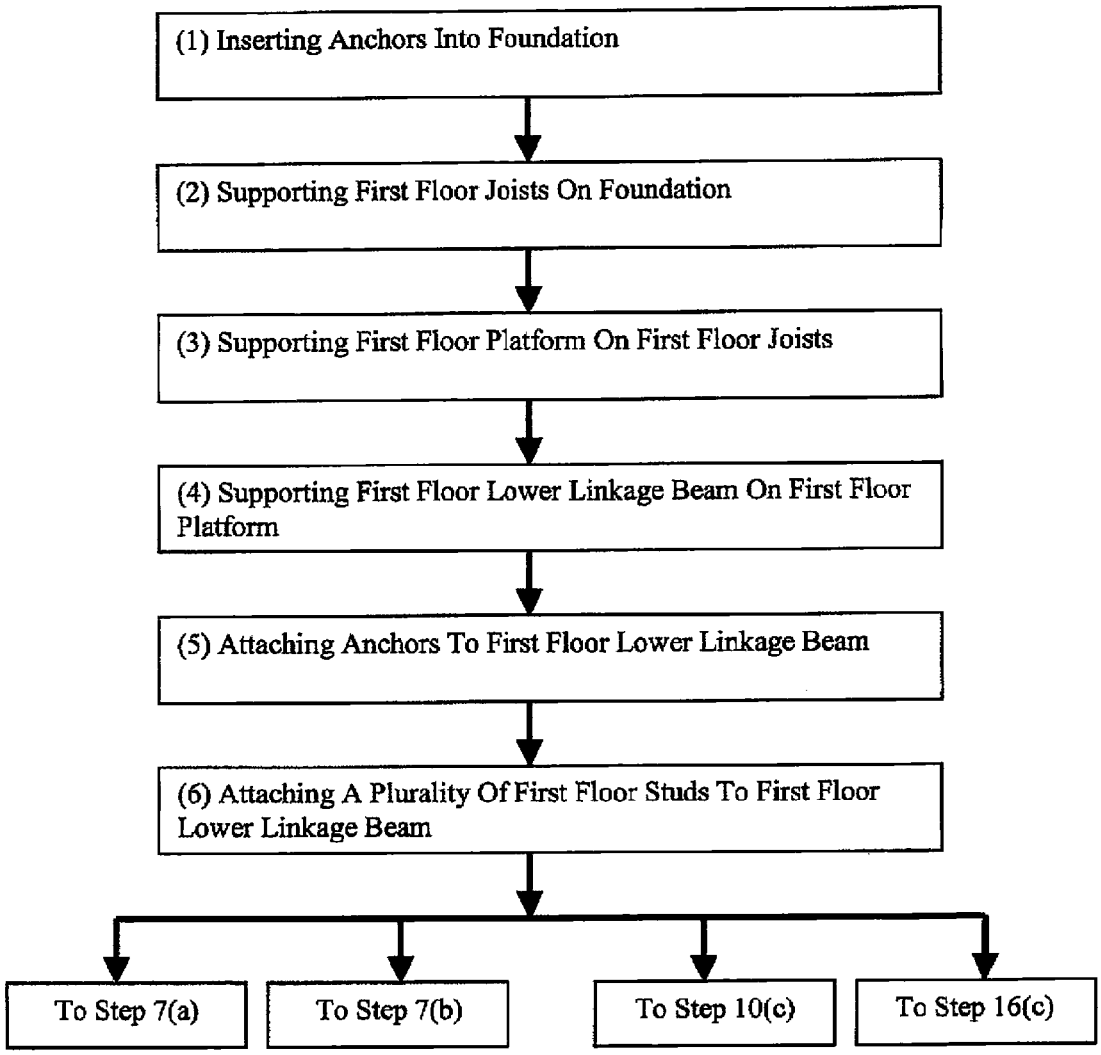
FIG. 16A depicts selected embodiments of steps of a method for securing a wall system together in a vertical direction.

Various embodiments of a method are also disclosed herein for securing a wall system together in a vertical direction as shown in FIG. 16A with additional reference to FIGS. 1-6. The steps include (1) inserting anchors 6 into a foundation 4, (2) supporting first floor joists 8 on the foundation 4, (3) supporting a first floor platform 10 on the first floor joists 8, (4) supporting a first floor lower linkage beam 12 on the first floor platform 10, (5) attaching the anchors 6 to the first floor lower linkage beam 12, and (6) attaching a plurality of first floor studs 14 to the first floor lower linkage beam 12.

With reference again to FIG. 16B and FIGS. 6, 13, and 14, a related embodiment to steps (1) through (6) above includes the additional steps of (7)(a) supporting a roof top plate 88 on the first floor wall studs 14, (8)(a) supporting a roof linkage beam 92 on the roof top plate 88, and (9)(a) attaching the roof joists 90 to the roof linkage beam 92.

As shown in FIG. 16C and FIGS. 7-9, another embodiment of the method described above in steps (1) through (6) includes the additional steps of (7)(b) supporting a first floor top plate 50 on the first floor wall studs 14, (8)(b) supporting a first floor upper linkage beam 52 on the first floor top plate 50, (9)(b) supporting a plurality of second floor joists 54 on the first floor top plate 50, (10)(b) supporting a second floor platform 56 on the second floor joists 54, (11)(b) supporting a second floor lower linkage beam 58 on the second floor platform 56, and (12)(b) attaching the first floor upper linkage beam 52 to the second floor lower linkage beam 58.

Another embodiment related to steps (1) through (12)(b) above includes the steps of (13)(b) supporting a roof top plate 88 on the second floor wall studs 82, (14)(b) supporting a roof linkage beam 92 on the roof top plate 88, and (15)(b) attaching the roof joists 90 to the roof linkage beam 92.

Figure 16B:
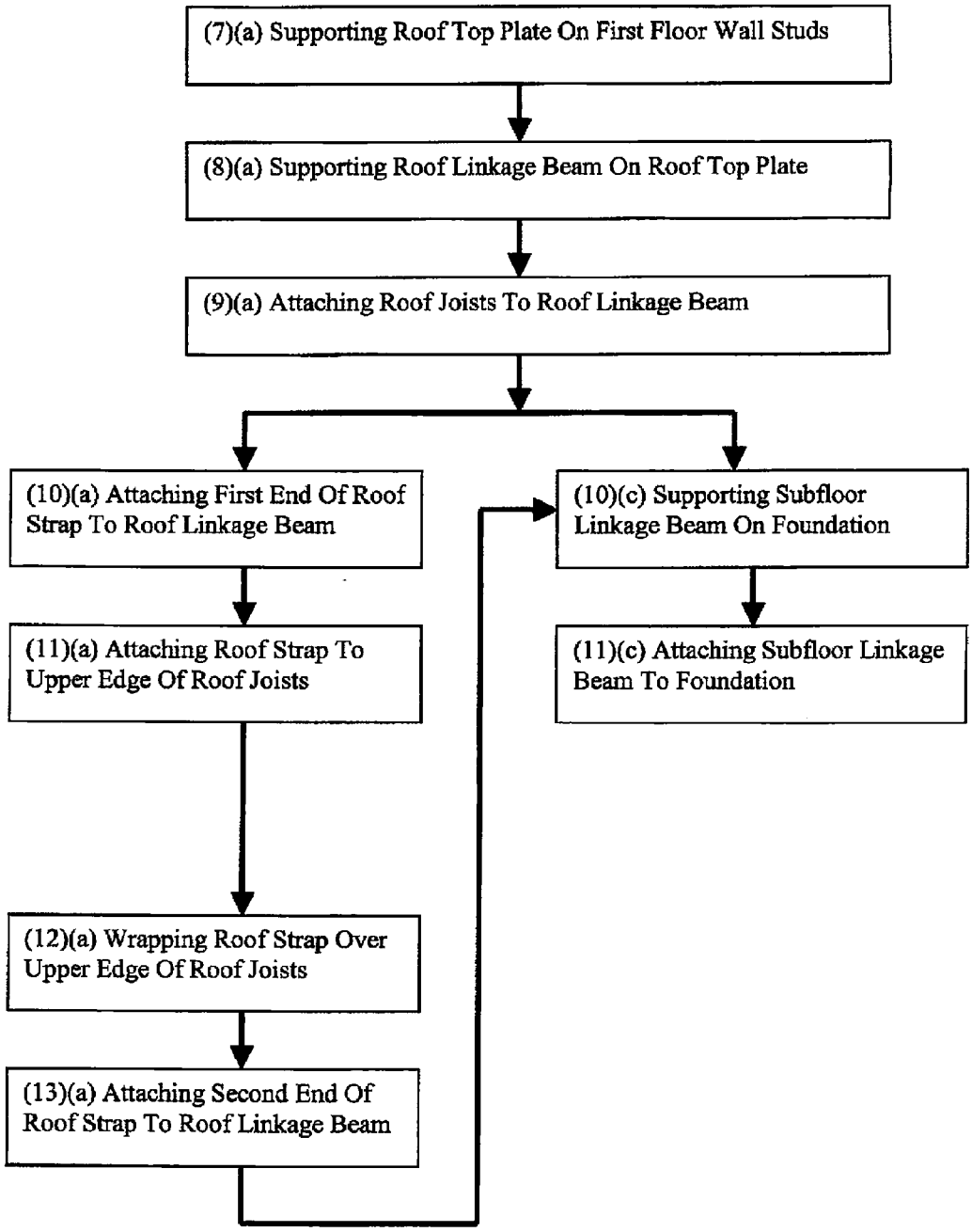
FIG. 16B depicts selected embodiments of steps of a method for securing a wall system together in a vertical direction.
Figure 16C:
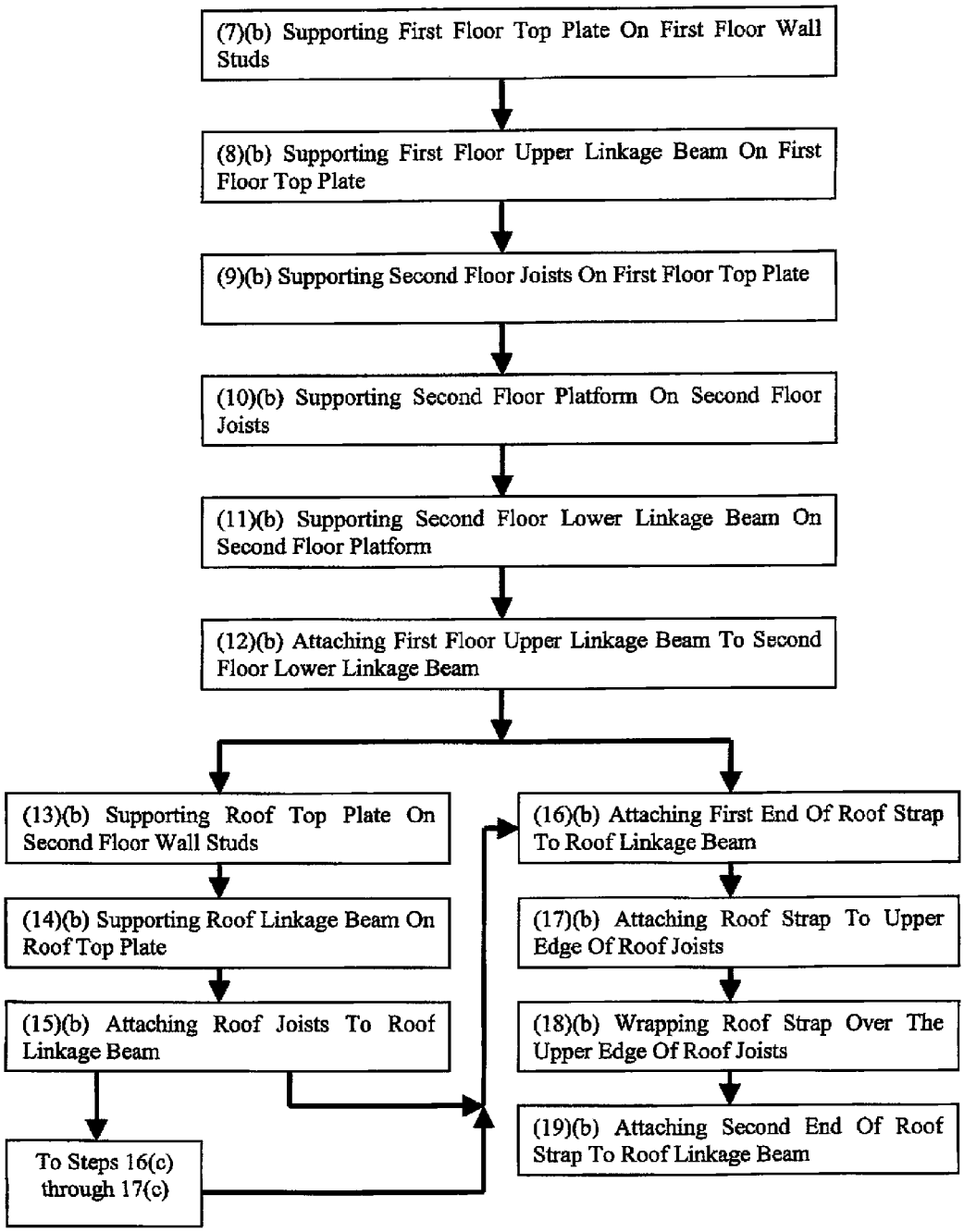
FIG. 16C depicts selected embodiments of steps of a method for securing a wall system together in a vertical direction.

As shown in FIG. 16B, yet another embodiment related to step (1) through step (9)(a) described above includes the additional steps of (10)(a) attaching a first end 112 of a roof strap 106 to the roof linkage beam 92, and (11)(a) attaching the roof strap 106 to an upper edge 108 of at least one of the roof joists 90. In an alternative embodiment related to step (1) through step (15)(b) as shown in FIG. 16C, the additional steps are numbered differently and include (16)(b) attaching a first end 112 of a roof strap 106 to the roof linkage beam 92, and (17)(b) attaching the roof strap 106 to an upper edge 108 of at least one of the roof joists 90.

FIGS. 12, 13, and 16B show additional embodiments related to step (1) through step (11)(a) described above including the steps of (12)(a) wrapping the roof strap 106 over the upper edge 108 of at least one of the roof joists 90 and (13)(a) attaching a second end 114 of the roof strap 106 to the roof linkage beam 92. In an alternative embodiment related to step (1) through step (17)(b) as shown in FIG. 16C, the additional steps are numbered differently and include (18)(b) wrapping the roof strap 106 over the upper edge 108 of at least one of the roof joists 90 and (19)(b) attaching a second end 114 of the roof strap 106 to the roof linkage beam 92.

As shown in FIG. 16B, an embodiment including certain combinations of the steps disclosed above further includes the steps of (10)(c) supporting a subfloor linkage beam 38 on the foundation 4 and (11)(c) attaching the subfloor linkage beam 38 to the foundation 4. Alternatively, as shown in FIG. 16C, the steps are numbered differently and include (16)(c) supporting a subfloor linkage beam 38 on the foundation 4 and (17)(c) attaching the subfloor linkage beam 38 to the foundation 4. Those skilled in the art appreciate that various embodiments allow for step (10)(c) and step (11)(c) to occur in addition to or instead of step (10)(a) through step (13)(a). Similarly, step (16)(c) and step (17)(c) may occur in addition to or instead of step (16)(b) through step (19)(b). It should also be understood by those skilled in the art that the steps shown in FIGS. 16A, 16B, and 16C do not necessarily occur in any given order so long as all of the steps in any given embodiment are used together.

Figure 17:
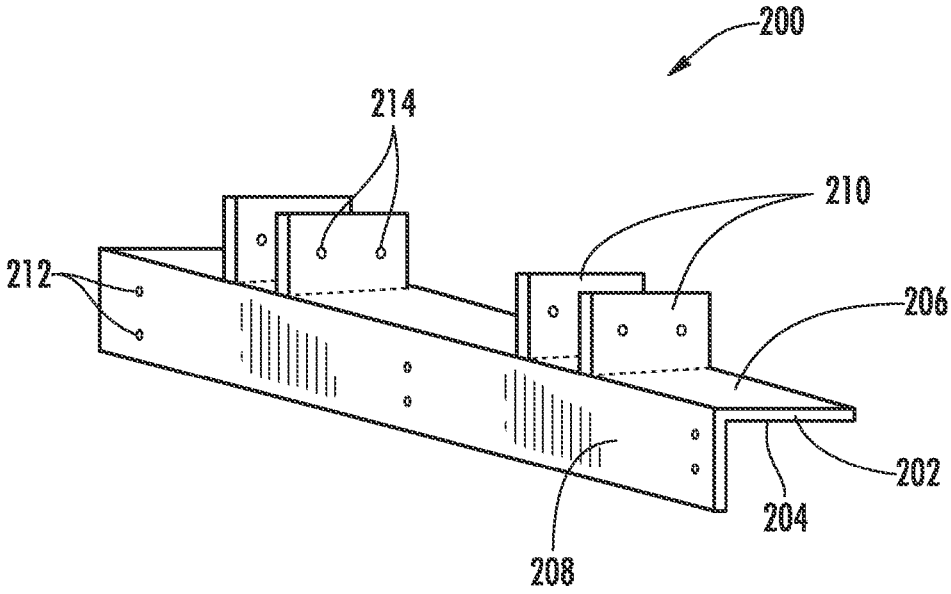
FIG. 17 depicts a perspective view of an apparatus for securing portions of a wall system together.

As shown in FIG. 17, an apparatus 200 for securing portions of a wall system together is also disclosed herein. The apparatus 200 is similar or identical to certain elements described above including first floor lower linkage beam 12, first floor upper linkage beam 52, second floor lower linkage beam 58, roof linkage beam 92, and subfloor linkage beam 38. The apparatus 200 includes an elongate base plate 202 having a first surface 204 and a second surface 206. An elongate parallel flange 208 is attached to the base plate 202 in a substantially parallel orientation to the base plate 202. In a preferred embodiment, the apparatus 200 includes a plurality of parallel flanges 210. The elongate parallel flange 208 preferably extends in a direction substantially normal to the first surface 204 of the base plate 202. The apparatus 200 also includes perpendicular flanges 210 attached to the second surface 206 of the base plate 202 perpendicular to the orientation of the base plate 202. The perpendicular flanges 210 preferably extend in a direction substantially normal to the second surface 206 of the base plate 202. The perpendicular flanges 210 are arranged to easily receive one or more joists for systematically constructing a structure. The spacing between sets of perpendicular flanges 210 varies and is based on customary building standards and measurements as well as local, state, and federal building codes.

In a preferred embodiment, one or more parallel flanges 208 include parallel flange apertures 212 for inserting a fastening means to fasten the apparatus 200 to studs and the like. Similarly, in a related preferred embodiment, the perpendicular flanges 210 include perpendicular flange apertures 214 for inserting a fastening means to fasten the apparatus 200 to joists and the like. The spacing between parallel flange apertures 208 as well as the spacing between perpendicular flange apertures 214 varies and is based on customary building standards and measurements as well as local, state, and federal building codes.

The foregoing description of preferred embodiments for this invention have been presented for purposes of illustration and description. They are not intended to be exhaustive or to limit the invention to the precise form disclosed. Obvious modifications or variations are possible in light of the above teachings. The embodiments are chosen and described in an effort to provide the best illustrations of the principles of the invention and its practical application, and to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. An apparatus for securing a wall system together in a vertical direction comprising:

a. a foundation;

b. a plurality of anchors secured to the foundation;

c. a plurality of first floor joists supported on the foundation;

d. a first floor platform supported on the first floor joists;

e. a first floor lower linkage beam including i. an elongate first floor lower linkage beam base supported on the first floor platform above at least some of the anchors, and ii. a first floor lower linkage beam flange extending vertically upward from the first floor lower linkage beam base and extending lengthwise horizontally;

f. a plurality of first floor elongate connectors attached to the anchors and the first floor lower linkage beam; and g. a plurality of first floor wall studs attached to the first floor lower linkage beam flange and extending upwardly from the first floor lower linkage beam base.

2. The apparatus of claim 1, further comprising a subfloor linkage beam including an elongate subfloor linkage beam base supported on the foundation along at least some of the anchors, and a subfloor linkage beam flange extending downwardly from the subfloor linkage beam base, wherein the subfloor linkage beam flange is attached to the foundation.

3. The apparatus of claim 1, further comprising:

a. a first floor top plate supported on the first floor wall studs;

b. a first floor upper linkage beam including an elongate first floor upper linkage beam base supported on the first floor top plate, and a first floor upper linkage beam flange extending downwardly from the first floor upper linkage beam base;

c. a plurality of second floor joists supported on the first floor upper linkage beam;

d. a second floor platform supported on the second floor joists;

e. a second floor lower linkage beam including i. an elongate second floor lower linkage beam base supported on the second floor platform, and ii. a second floor lower linkage beam flange extending upwardly from the second floor lower linkage beam base; and f. a plurality of second floor elongate connectors attached to the first floor upper linkage beam and the second floor lower linkage beam.

4. The apparatus of claim 3, further comprising a plurality of second floor wall studs attached to the second floor lower linkage beam flange and extending upwardly from the second floor lower linkage beam base.

5. The apparatus of claim 1, further comprising:

a. a rooftop plate supported on the N floor wall studs, wherein "N" is an ordinal number;

b. a plurality of roof joists; and c. a roof linkage beam, wherein the roof joists are supported on the roof linkage beam, and wherein the roof linkage beam includes an elongate roof linkage beam base supported on the roof top plate, a roof linkage beam flange extending downwardly from the roof linkage beam base, and a plurality of roof linkage beam flanges extending upwardly for receiving the roof joists and extending perpendicular to the first floor lower linkage beam flange.

6. The apparatus of claim 5 further comprising a joist strap attached to at least one of the roof linkage beam flanges and at least one of the roof joists.

7. The apparatus of claim 1 wherein the first floor lower linkage beam flange is attached to at least one of the first floor wall studs by fasteners inserted into the at least one of the first floor wall studs at an angle substantially parallel to the first floor lower linkage beam base.

8. The apparatus of claim 2 wherein the subfloor linkage beam flange is attached to the foundation by fasteners inserted into the foundation at an angle substantially parallel to the subfloor linkage beam base.

9. The apparatus of claim 3 wherein the first floor upper linkage beam flange is attached to at least one of the first floor wall studs by fasteners inserted into the at least one of the first floor wall studs at an angle substantially parallel to the first floor upper linkage beam base.

10. The apparatus of claim 4 wherein the second floor lower linkage beam flange is attached to at least one of the second floor wall studs by fasteners inserted into the at least one of the second floor wall studs at an angle substantially parallel to the second floor lower linkage beam base.

11. The apparatus of claim 5 wherein the roof linkage beam flange is attached to at least one of the N floor wall studs by fasteners inserted into the at least one of the N floor wall studs at an angle substantially parallel to the roof linkage beam base.

12. An apparatus for securing a wall system together in a vertical direction comprising:

a. a foundation;

b. a plurality of anchors secured to the foundation;

c. a plurality of first floor joists supported on the foundation;

d. a first floor platform supported on the first floor joists;

e. a first floor lower linkage beam including i. an elongate first floor lower linkage beam base supported on the first floor platform above at least some of the anchors, and ii. a plurality of first floor lower linkage beam flanges extending vertically upward from the first floor lower linkage beam base and extending lengthwise horizontally;

f. a plurality of first floor elongate connectors attached to the anchors and the first floor lower linkage beam; and g. a plurality of first floor wall studs attached to the first floor lower linkage beam flanges and extending upwardly from the first floor lower linkage beam base, wherein the first floor lower linkage beam flanges are attached to at least one of the first floor wall studs by fasteners inserted into the at least one of the first floor wall studs substantially parallel to the first floor lower linkage beam base.

13. The apparatus of claim 12, further comprising a subfloor linkage beam including an elongate subfloor linkage beam base supported on the foundation along the anchors, and a subfloor linkage beam flange extending downwardly from the subfloor linkage beam base, wherein the subfloor linkage beam flange is attached to the foundation.

14. The apparatus of claim 12, further comprising:

a. a first floor top plate supported on the first floor wall studs;

b. a first floor upper linkage beam including an elongate first floor upper linkage beam base supported on the first floor top plate, and a first floor upper linkage beam flange extending downwardly from the first floor upper linkage beam base;

c. a plurality of second floor joists supported on the first floor upper linkage beam;

d. a second floor platform supported on the second floor joists;

e. a second floor lower linkage beam including i. an elongate second floor lower linkage beam base supported on the second floor platform, and ii. a second floor lower linkage beam flange extending upwardly from the second floor lower linkage beam base; and f. a plurality of second floor elongate connectors attached to the first floor upper linkage beam and the second floor lower linkage beam.

* * * * *

UNITED STATES PATENT AND TRADEMARK OFFICE

CERTIFICATE OF CORRECTION

PATENT NO. : 7,665,257 B2
APPLICATION NO. : 11/613655
DATED : February 23, 2010
INVENTOR(S) : Bobby R. Posey It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 360 days.

Signed and Sealed this

Seventh Day of December, 2010

David J. Kappos

David J. Kappos
*Director of the United States Patent and Trademark Office*